US009975232B2

(12) United States Patent
Neitzell et al.

(10) Patent No.: US 9,975,232 B2
(45) Date of Patent: May 22, 2018

(54) PIN ANCHOR DRIVER

(71) Applicant: Milwaukee Electric Tool Corporation, Brookfield, WI (US)

(72) Inventors: Roger D. Neitzell, Palmyra, WI (US); Ryan Malloy, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 638 days.

(21) Appl. No.: 13/771,394

(22) Filed: Feb. 20, 2013

(65) Prior Publication Data

US 2013/0221058 A1 Aug. 29, 2013

Related U.S. Application Data

(60) Provisional application No. 61/603,637, filed on Feb. 27, 2012.

(51) Int. Cl.
*B25D 17/02* (2006.01)
*B25B 23/12* (2006.01)
*B25B 31/00* (2006.01)

(52) U.S. Cl.
CPC ..... *B25D 17/02* (2013.01); *B25B 23/12* (2013.01); *B25B 31/00* (2013.01)

(58) Field of Classification Search
CPC ..... B25B 23/12; B25B 31/00; B25D 17/02
USPC ..... 227/147
See application file for complete search history.

(56) References Cited

U.S. PATENT DOCUMENTS 3,934,779 A 1/1976 Dent
4,007,795 A 2/1977 Gawron et al.
4,367,836 A 1/1983 Hodson
4,525,111 A 6/1985 Gutsche
4,562,948 A * 1/1986 Floyd ..... B25C 1/02 227/113
4,676,424 A * 6/1987 Meador ..... B25C 1/02 227/147
4,867,249 A 9/1989 Watkins, Jr. et al.
4,890,779 A 1/1990 Giannuzzi
5,030,043 A 7/1991 Fischer et al.
5,199,625 A 4/1993 Dewey et al.
5,327,631 A 7/1994 Lincavage
5,365,648 A 11/1994 Fuga
5,638,909 A 6/1997 Henderson
5,979,913 A 11/1999 Kosik et al.
6,345,755 B1 2/2002 Fields
6,402,007 B1 6/2002 Dyer
6,446,318 B1 9/2002 Foose
6,490,773 B1 12/2002 Estes et al.
6,585,143 B1 7/2003 Schultz
6,585,456 B2 7/2003 Forse
6,915,936 B2 7/2005 Estes
(Continued)

OTHER PUBLICATIONS

DeWalt Model No. DW5517PAD Pin Anchor Drive System, commercially available at least as early as Nov. 3, 2011.

*Primary Examiner* — Hemant M Desai
*Assistant Examiner* — Mary Hibbert
(74) *Attorney, Agent, or Firm* — Michael Best & Friedrich LLP

(57) ABSTRACT

A pin anchor driver for use with a rotary hammer includes a main shaft having a bore in which a drill bit of the rotary hammer is at least partially receivable, a driver head coupled to the main shaft, and a magnet positioned between the main shaft and the driver head.

15 Claims, 3 Drawing Sheets

(56) References Cited

U.S. PATENT DOCUMENTS

| | | | | |
|---|---|---|---|---|
| 7,124,665 | B1 | 10/2006 | Chen | |
| 7,407,071 | B2 | 8/2008 | Sperrfechter et al. | |
| 7,814,631 | B2 | 10/2010 | Wallek | |
| 8,061,000 | B2 | 11/2011 | Satamarina et al. | |
| 2005/0178244 | A1 | 8/2005 | Hodges | |
| 2007/0051208 | A1* | 3/2007 | Stephens | B25C 3/006 81/44 |
| 2009/0302088 | A1* | 12/2009 | Santamarina | B25B 31/00 227/139 |
| 2010/0264191 | A1 | 10/2010 | Foster et al. | |
| 2011/0089218 | A1 | 4/2011 | Santamarina et al. | |

* cited by examiner

PIN ANCHOR DRIVER

CROSS-REFERENCE TO RELATED APPLICATIONS

This application claims priority to U.S. Provisional Patent Application No. 61/603,637 filed on Feb. 27, 2012, the entire content of which is incorporated herein by reference.

FIELD OF THE INVENTION

The present invention relates to pin anchors, and more particularly to tools used for driving pin anchors into a concrete or masonry structure.

BACKGROUND OF THE INVENTION

Multiple different tools are typically required for installing pin anchors in concrete or masonry structures. For example, a drill may be first used to form a hole in the concrete or masonry structure. Then, the pin anchor is inserted into the hole and a hammer may be utilized to pound the pin anchor into the masonry material.

SUMMARY OF THE INVENTION

The invention provides, in one aspect, a pin anchor driver for use with a rotary hammer. The pin anchor driver includes a main shaft having a bore in which a drill bit of the rotary hammer is at least partially receivable, a driver head coupled to the main shaft, and a magnet positioned between the main shaft and the driver head.

The invention provides, in another aspect, a tool for driving pin anchors. The tool includes a main shaft, a non-ferrous driver head coupled to the main shaft, and a magnet positioned between the main shaft and the driver head. The tool also includes a sleeve slidably disposed on the main shaft between extended and retracted positions for supporting a pin anchor therein.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
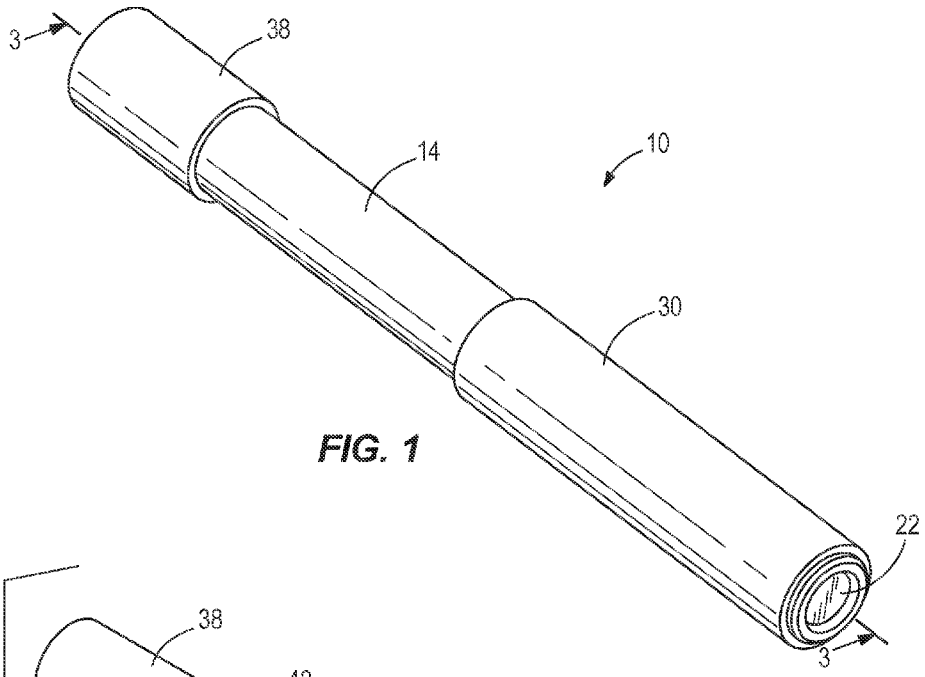
FIG. 1 is a front perspective view of a pin anchor driver according to one embodiment of the invention.
Figure 2:
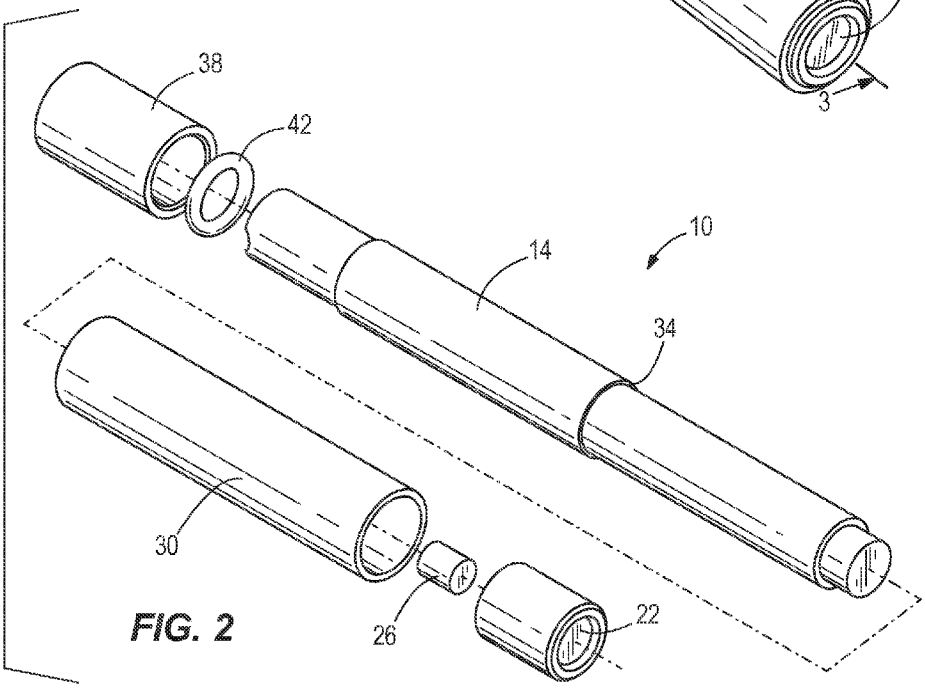
FIG. 2 is an exploded, front perspective view of the pin anchor driver of FIG. 1.
Figure 3:
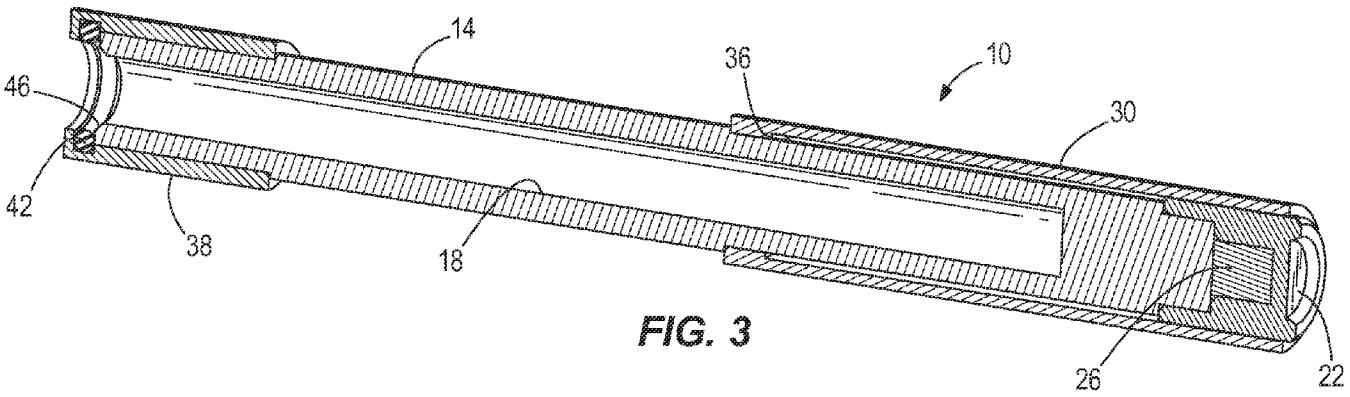
FIG. 3 is a cross-sectional view of the pin anchor driver of FIG. 1, illustrating a sleeve of the pin anchor driver in a retracted position.
Figure 5:
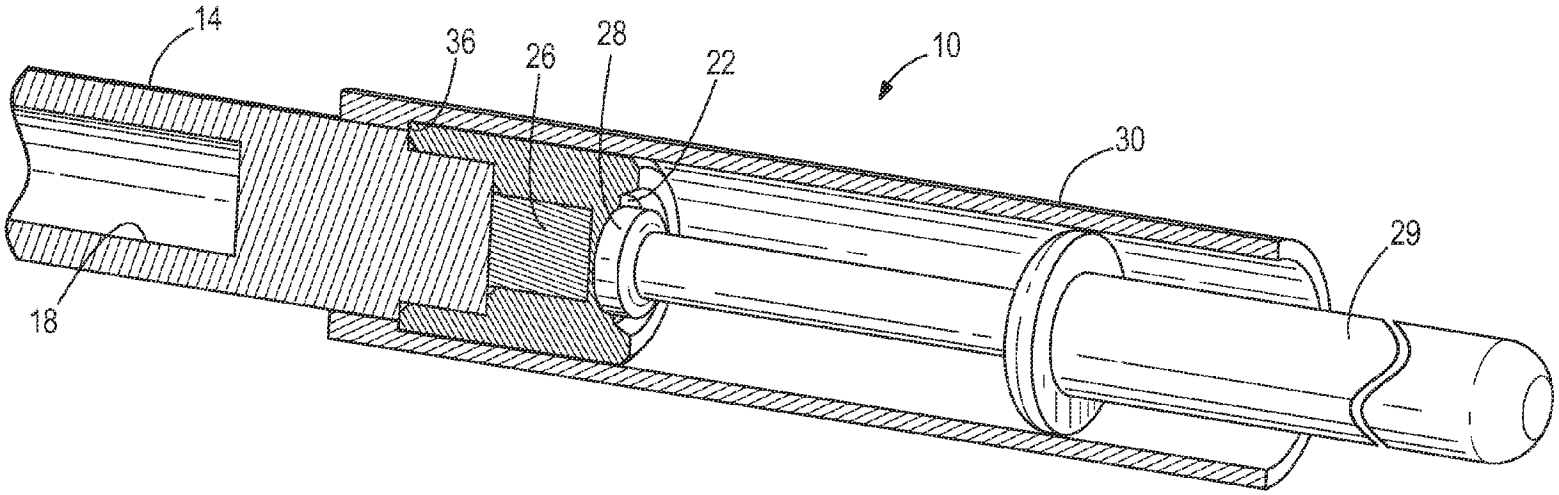
FIG. 5 is an enlarged, cross-sectional view of the pin anchor driver of FIG. 1, illustrating the sleeve in an extended position and a pin anchor received within the sleeve.

FIG. 1 illustrates a pin anchor driver 10 that is used with a rotary hammer (not shown) for driving pin anchors into concrete or other masonry surfaces. Such pin anchors are used to attach brackets and like structure to concrete surfaces. The pin anchor driver 10 includes a main shaft 14 having a longitudinal blind bore 18, a non-magnetic (e.g., stainless steel) driver head 22 press-fit to the main shaft 14, and a magnet 26 positioned between the main shaft 14 and the driver head 22 (FIGS. 2 and 3). As such, the main shaft 14, the driver head 22, and the magnet 26 are coaxial. The driver head 22 includes a recess in which a head 28 of a pin anchor 29 is at least partially received (FIG. 5).

Figure 4:
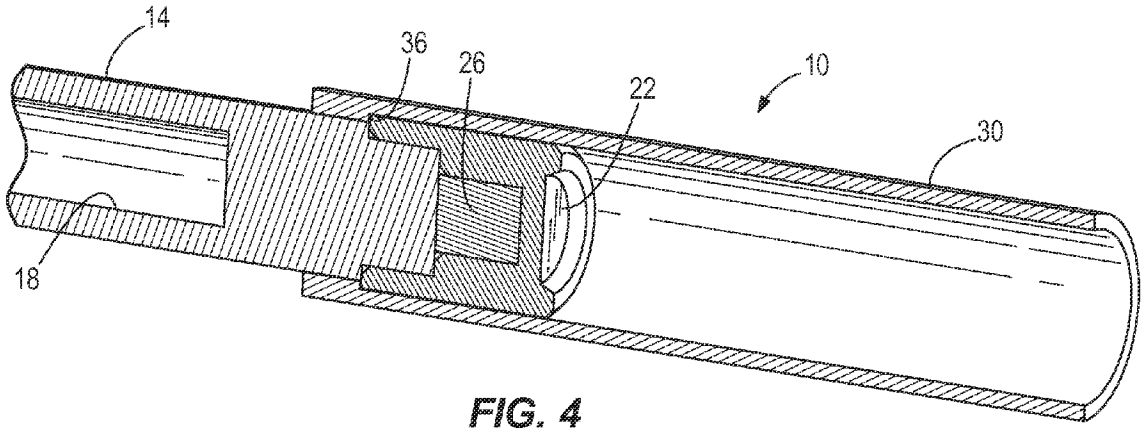
FIG. 4 is an enlarged, cross-sectional view of the pin anchor driver of FIG. 1, illustrating the sleeve in an extended position.

The pin anchor driver 10 also includes a sleeve 30 slidably disposed on the main shaft 14 between an extended position (FIGS. 4 and 5) in which the pin anchor 29 may be at least partially received within the sleeve 30, and a retracted position (FIGS. 1 and 3). In the extended position (FIGS. 4 and 5), the sleeve 30 axially overlaps the pin anchor 29 when the head 28 of the pin anchor 29 is positioned adjacent the driver head 22. A magnetic force exerted by the magnet 26 on the pin head 28 maintains the pin head 28 adjacent and in contact with the driver head 22. Movement of the sleeve 30 is confined between the extended and retracted positions by the driver head 22 and a shoulder 34 formed around the exterior of the main shaft 14 (FIG. 2), respectively. Alternatively, the shoulder 34 may be replaced by a retaining ring on the main shaft 14. As shown in FIG. 4, the outer diameter of the driver head 22 is larger than the inner diameter of an internal shoulder 36 of the rear end of the sleeve 30 (i.e., the end opposite that which engages the workpiece). As such, interference with the driver head 22 prevents the sleeve 30 from being removed from the main shaft 14.

The pin anchor driver 10 further includes a retaining collar 38 press-fit to the outer periphery of the main shaft 14 (FIGS. 1-3). An O-ring 42 is received within an inner circumferential groove in the retaining collar 38.

To use the pin anchor driver 10, a drill bit of the rotary hammer (not shown) is inserted in the blind bore 18 of the main shaft 14. A shoulder on the drill bit engages an internal shoulder 46 (FIG. 3) of the main shaft 14 to limit the extent to which the drill bit may be inserted into the bore 18. The O-ring 42 frictionally engages the drill bit for holding the pin anchor driver 10 to the drill bit and the rotary hammer. The sleeve 30 is moved to the extended position, and a pin anchor 29 is positioned within the sleeve 30 with the pin head 28 located adjacent and in contact with the driver head 22. The pin head 28 is held in contact with the driver head 22 by the magnet 26. A distal end of the sleeve 30 is then positioned against a workpiece (e.g., a bracket), with the pin anchor 29 aligned with an aperture in the workpiece and a bore in the underlying concrete or masonry surface. When the rotary hammer is activated in impact-only mode (i.e., without rotation), axial impacts are transferred from the drill bit to the driver head 22 via the main shaft 14 for incrementally driving the pin anchor 29 into the workpiece and the underlying concrete or masonry surface. As the pin anchor 29 is incrementally driven in this manner, the sleeve 30 moves from the extended position to the retracted position.

Various features of the invention are set forth in the following claims.

What is claimed is:

1. A pin anchor driver for use with a rotary hammer, the pin anchor driver comprising:

a main shaft including a bore in which a drill bit of the rotary hammer is at least partially receivable;

a driver head affixed to the main shaft and having a diameter greater than a diameter of the main shaft to define a lip at an interface between the driver head and the main shaft, the driver head configured to deliver axial impacts from the drill bit to a pin anchor during operation of the rotary hammer, the driver head having a recess configured to receive a head of the pin anchor;

a sleeve slidably disposed on the main shaft between extended and retracted positions for supporting the pin anchor therein; and a magnet positioned between the main shaft and the driver head, wherein the main shaft, the driver head, and the magnet are movable together relative to the sleeve, wherein the sleeve includes an internal shoulder engageable with the lip in the extended position to limit movement of the sleeve to the extended position, and wherein the magnet is configured to exert a magnetic force on the pin anchor tending to maintain the head of the pin anchor in the recess when the sleeve is in the extended and retracted positions.

2. The pin anchor driver of claim 1, wherein the sleeve axially overlaps the pin anchor when in the extended position.

3. The pin anchor driver of claim 2, wherein a head of the pin anchor is positioned adjacent the driver head, and wherein a magnetic force exerted by the magnet on the head of the pin anchor maintains the head of the pin anchor adjacent the driver head.

4. The pin anchor driver of claim 1, wherein the main shaft includes a shoulder, and wherein the sleeve is engageable with the shoulder when in the retracted position.

5. The pin anchor driver of claim 1, further comprising:

a retaining collar coupled to the main shaft; and an O-ring positioned within the retaining collar and engageable with the drill bit for securing the pin anchor driver to the drill bit.

6. The pin anchor drive of claim 5, wherein the retaining collar is press-fit to the main shaft.

7. The pin anchor drive of claim 1, wherein the main shaft includes an internal shoulder for limiting the extent to which the drill bit is received within the main shaft.

8. The pin anchor driver of claim 1, wherein the main shaft, the driver head, and the magnet are coaxial.

9. The pin anchor driver of claim 1, wherein the driver head is non-magnetic.

10. The pin anchor driver of claim 1, wherein the driver head includes a bore in which the magnet is positioned.

11. The pin anchor driver of claim 1, wherein the driver head is press fit to the main shaft.

12. The pin anchor driver of claim 1, wherein the magnet is fixed to the driver head, and wherein the sleeve is slidable between the extended and retracted positions relative to the magnet.

13. The pin anchor driver of claim 1, wherein the magnet abuts a distal end of the main shaft.

14. The pin anchor driver of claim 1, wherein the magnet is substantially surrounded by the driver head.

15. A pin anchor driver for use with a rotary hammer, the pin anchor driver comprising:

a main shaft including a bore in which a drill bit of the rotary hammer is at least partially receivable;

a non-magnetic driver head affixed to the main shaft, the driver head configured to deliver axial impacts from the drill bit to a pin anchor during operation of the rotary hammer, the driver head having a diameter greater than a diameter of the main shaft to define a lip at an interface between the driver head and the main shaft;

a sleeve slidably disposed on the main shaft between extended and retracted positions for supporting the pin anchor therein; and a magnet positioned between the main shaft and the driver head, wherein the main shaft, the driver head, and the magnet are movable together relative to the sleeve, and wherein the magnet is configured to exert a magnetic force on the pin anchor tending to maintain the head of the pin anchor in the recess when the sleeve is in the extended and retracted positions.

* * * * *